US005727677A

United States Patent [19]

Peviani

[11] Patent Number: 5,727,677

[45] Date of Patent: Mar. 17, 1998

[54] CONTAINER FOR CUTLERY AND IMITATION JEWELRY GIVEN ANTI-BACTERIAL AND ANTI-MYCOTIC TREATMENT

[76] Inventor: Claudio Peviani, Via Luigi Salma, 20, 20094 Corsico (Milano), Italy

[21] Appl. No.: 792,155

[22] Filed: Jan. 30, 1997

Related U.S. Application Data

[63] Continuation of Ser. No. 367,202, filed as PCT/IT92/00100, Aug. 7, 1992, published as WO94/01014, Jan. 20, 1994, abandoned.

[30] Foreign Application Priority Data

Jul. 14, 1992 [IT] Italy ..... MI92A1695

[51] Int. Cl.[6] ..... B65D 81/24

[52] U.S. Cl. ..... 206/205; 206/6.1; 206/553

[58] Field of Search ..... 206/6.1, 205, 377, 206/376, 553, 566; 150/154, 165

[56] References Cited

U.S. PATENT DOCUMENTS

| | | | |
|---|---|---|---|
| 1,565,389 | 12/1925 | Peacock | 206/553 |
| 1,673,602 | 6/1928 | Sternthal | 206/553 |
| 4,887,715 | 12/1989 | Spahn et al. | 206/438 |
| 5,046,604 | 9/1991 | Forhetz et al. | 206/205 |

*Primary Examiner*—David T. Fidei
*Attorney, Agent, or Firm*—Michael J. Striker

[57] ABSTRACT

Containers (10) for cutlery (28–31), real and artificial jewelry generally, treated with chemical preparations whose action is antibacterial, antimycotic, and antiseptic in general, said treatment being given on the various component parts (11–21, 25) forming the structures coverings and linings as well as on the raw or semiprocessed materials used in production of the individual components.

10 Claims, 7 Drawing Sheets

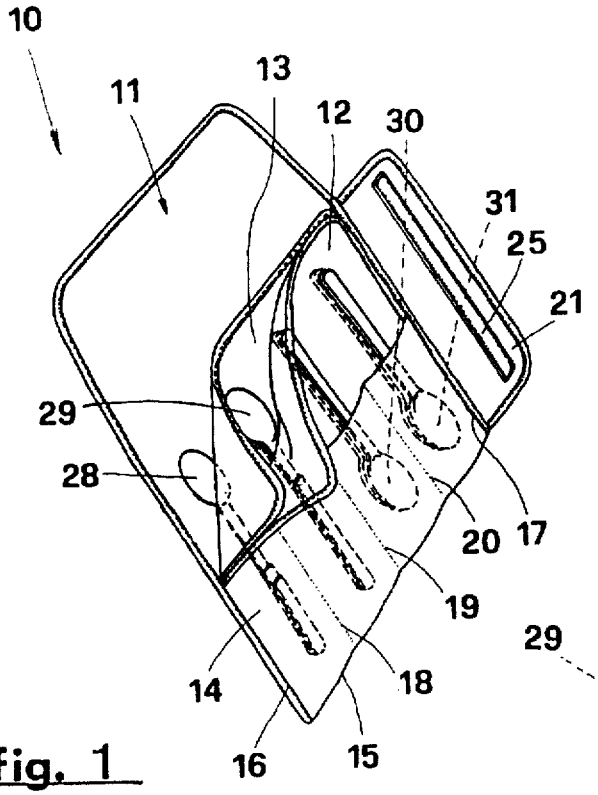
fig. 1
fig. 2
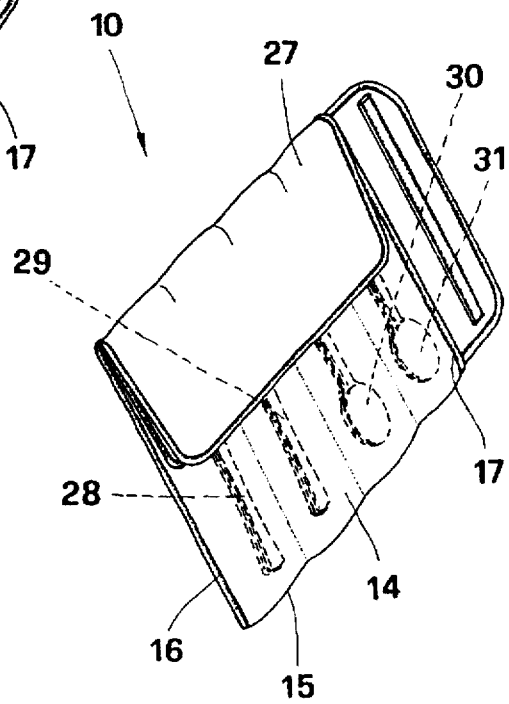
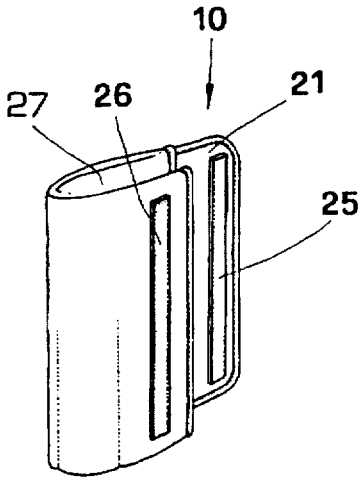
fig. 3
fig. 4
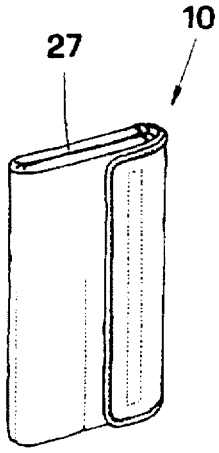

CONTAINER FOR CUTLERY AND IMITATION JEWELRY GIVEN ANTI-BACTERIAL AND ANTI-MYCOTIC TREATMENT

This application is a continuation of application Ser. No. 08/367,202, filed Jan. 13, 1995, now abandoned, which is a 371 of PCT/IT92/00100, filed Aug. 7, 1992, published as WO94/01014 Jan. 20, 1994.

BACKGROUND OF THE INVENTION

The purpose of containers for cutlery, real and artificial jewelry and the like is to preserve and protect the contents and to make the most of their appearance and function when brought into use.

Similarly well known as the above are the risks of new types of contagious and infectious diseases whose seriousness has only lately become known and adequately evaluated. Bearing in mind the nature of the objects preserved as above and the frequent handling they receive, it is clear that they can be easily infected and also infect people.

SUMMARY OF THE INVENTION

Purpose of the above invention is to render impossible or at least greatly reduce this risk of contagion or infection. Subject of the invention is a series of soft, rigid or semi-rigid containers, for cutlery, necklaces, bracelets, earrings, rings, pendants, medals and other objects, such containers being roll-up or in the forms of bags, cases, boxes, sets of drawers, trays, caskets or sample cases, to hold cutlery, real and artificial jewelry generally, and treated to provide anti-bacterial, antimyotic and antiseptic action.

This chemical treatment is given to the various components of the containers, both structural and coverings or linings, therefore consisting, as the case may be, of cloth, fabric or non-fabric, paper, cardboard, with parts of wood, metal plastic material or some other kind.

The treatment is also given to accessories for holding the contents in place, which accessories may be of fabric, plastric materials, metals etcetera.

Chemical treatment may further be applied to the raw or semiprocessed materials used to make components such as the thread for creating structural divisions or suchlike. Chemical treatment may be carried out on the containers themselves either during the course of production or when they are completed.

Such treatment can be effected by spraying or by immersion or in some other way.

One type of container is of a soft structure and is divided into compartments for receiving cutlery.

Said compartments are formed by superimposing layers of cloth sewn together by longitudinal parallel stitching.

Further parallel rows of stitching form single compartments. At the righthand edge of the container, of length equivalent to that of the pieces of cutlery, is a flap of material. Two matching strips of Velcro-type material are attached to said flap and to the lefthand edge of the container. Thus, by folding the back layer over the compartments, then the left of the container over the right, longitudinally, and then the above flap over the back of the folded left side, the two strips of Velcro will match up and close the container as if it were a book.

The compartments of the container here described are preferably arranged in two or more superimposed sets, each consisting of four compartments so as to hold a large number of pieces of cutlery.

There are more than two layers used to form compartments. The front layer is about half as long as the length of the cutlery to be housed, the internal layers are about the same length as the cutlery while the back layer is almost double to allow it to be folded down over the cutlery put away into the compartments.

The rows of stitching are about half as long as the cutlery to enable the internal layers to be folded down over the compartments in front of them when they are empty, and so make it easier to reach the rear compartments behind said folded internal layers.

Preferably the compartments are wide enough to allow cutlery, especially spoons, to be put in handles down; in this way some can go in handles down and some handles up so that, when superimposed, placed in the various sets of superimposed compartments and the container is folded as above, this can be done reducing bulk to a minimum.

Preferably each set of compartments consists of four, all of equal width. The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1. Open view of a soft container for cutlery.

FIG. 2. The same container with the upper edge folded down.

FIG. 3. The container after being closed bookwise.

FIG. 4. The container when completely closed.

DESCRIPTION OF THE PREFERRED EMBODIMENTS

Figure 6:
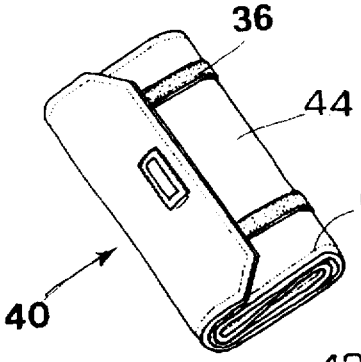
FIG. 6. The same as above when closed.

The container 10 comprises the back cloth 11, the internal layers of cloth 12 and 13, shorter than the back one, and the front cloth 14, shortest of all.

The above layers are held together by the longitudinal lines of stitching 16–20 more or less equally spaced. On the right hand side there is a longitudinal flap 21 about as long as the internal layers 12 and 13. Close to the longitudinal edge of said flap and on the back of the container close to the left hand longitudinal edge are two longitudinal strips of Velcro, 25 and 26. The length of the back layer of cloth 11 is about three times that of the front layer 14.

The lengths of the internal layers are about halfway between those of the front and back layers.

The object can obviously be made in a variety of sizes. As seen in the drawing three sets of four compartments are made, superimposed and of approximately the same width, a front set, a middle set and a back set.

The width of the compartments is such that they can accept 12 spoons, the first two 28, 29 starting from one side of the container, with handles down, and the other two 30, 31 with handles up, these being done in each of the three sets of four superimposed compartments.

To close the container 10 here described, the longer cloth 27 is folded down to cover the internal layers 12 and 13, and partially cover the front one 14 (FIG. 2).

The container is then closed bookwise folding left over right (FIG. 3).

Superimposed in this way the handles of the spoons 28, 29 will fit in with the other spoons 30, 31 in the adjacent compartments which have their concave parts on a level with the handles in the others.

Folded thus, a minimum total bulk is created.

The side flap 21 can then be folded onto the 'book' its strip of Velcro 25 coinciding with the strip of Velcro 26 on the back and closing the container completely. Seven containers of substantially the same kind can house and preserve a full set of table cutlery.

In particular, twelve spoons can for example of kept in the container described, twelve forks and twelve knives respectively in another two containers of the same kind.

A further twelve pieces of cutlery for fish and another twelve for fruit can be kept in two other smaller containers.

Twelve teaspoons can be kept in another still smaller container.

All the layers of the container, the back layer 11, the internal layers 12 and 13, and the front one 14 have been subjected to previous chemical treatment to provide antibacterial, antimycotic and antiseptic protection generally by a spray or immersion process or by other suitable processes.

In this way the container is antiseptic and the cutlery will be preserved from infection to the great benefit of those using it.

Figure 5:
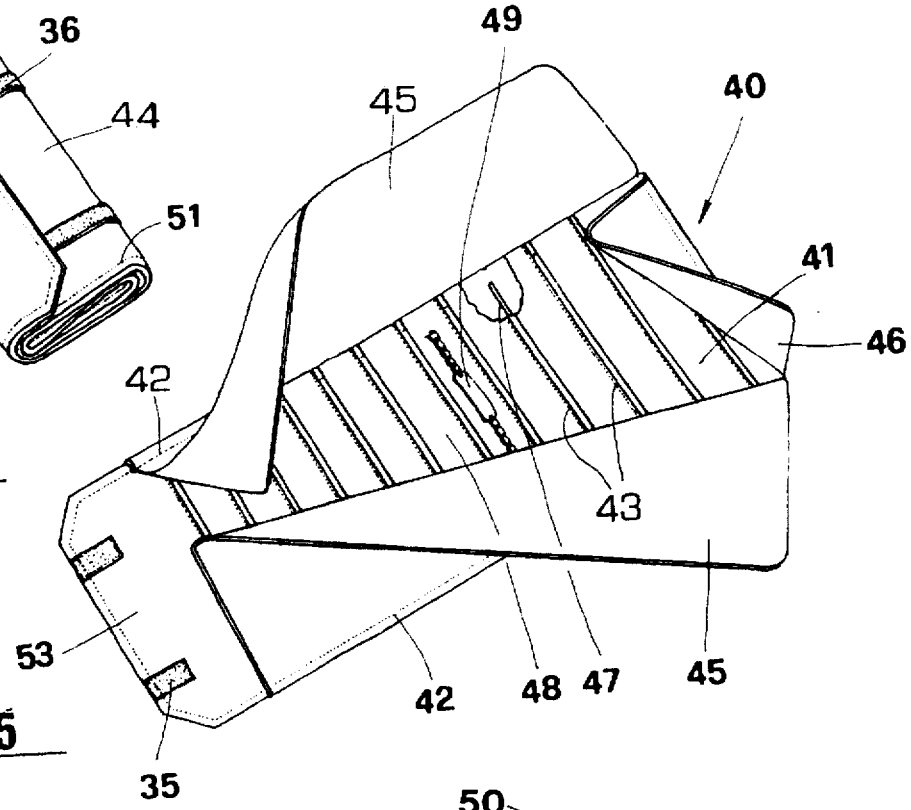
FIG. 5. Open view of a soft container for bracelets.

The strips of Velcro 25 and 26 have also been given prior chemical treatment to protect them from infection. FIGS. 5 and 6 show an open and a closed view of a soft container for bracelets.

This container consists of front layers 45, and end layer 46 and a central one 41 joined by stitching like 42. Stitched at the back, a decorated layer 44 is held to the central layer.

The container is closed by rolling it up and matching the Velcro strip 35, on the front layer, with the Velcro strips 36 placed on the back layer.

The thin bars 47 and lateral stitching 43, form the compartments 48 for bracelets 49.

All parts of the container, such as the layers 44–46, 41 and Velcro strips 35, 36, as well as the bars 47 have been given prior antibacterial, antimycotic and antiseptic treatment generally with chemical products.

After production the container has been further treated with chemical products to ensure its antiseptic properties even in the small spaces created by stitching, especially 43.

Figure 8:
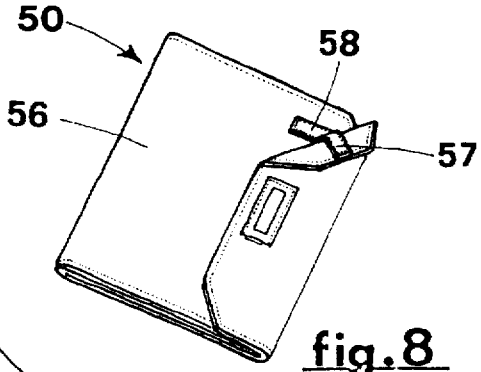
FIG. 8. The same as above when closed.
Figure 7:
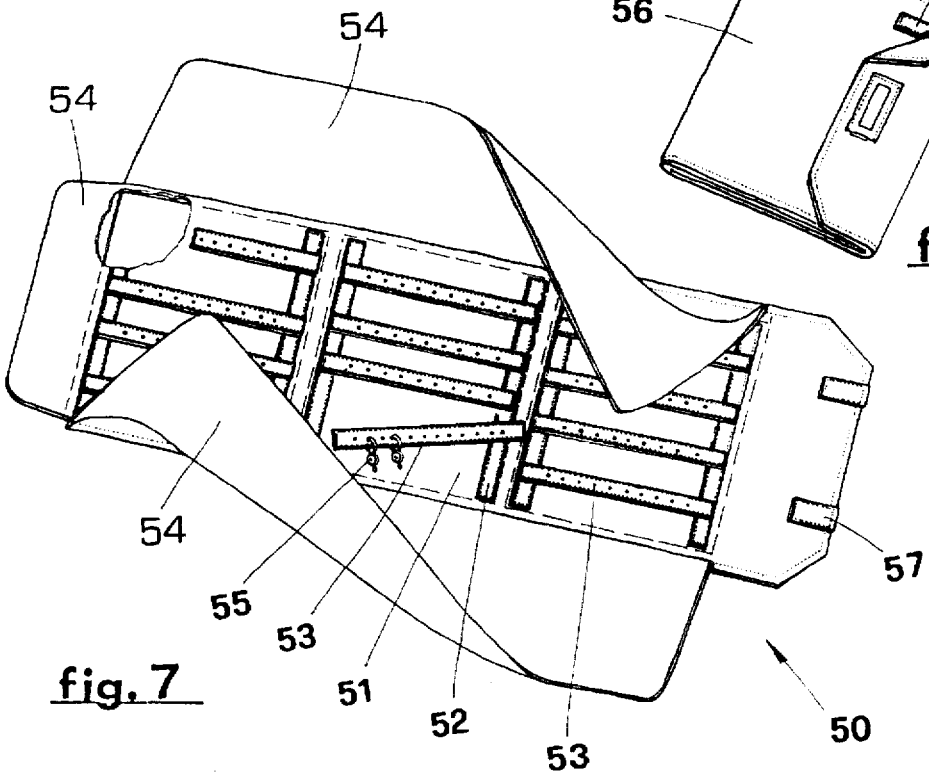
FIG. 7. Open view of a soft container for earrings.

FIGS. 7 and 8 illustrate a soft container 50 for earrings seen in both its open and closed positions. The container consists of front pieces 51 and 54 stitched to the back piece 56. Bands of Velcro 57, 58 close it. The earrings 55 hook into small holes in the strips 53 that can be fixed in the desired position on crosspieces 52 fixed on the bottom of the container.

The container is closed by upper bands of velcro on the crosspiece 52 and below, at the end, on the longitudinal strips 53.

All component parts like the pieces 51, 54, 56, the Velcro bands 57, 58, the crosspieces and longitudinal strips 52, 53 have been given prior treatment with chemical preparations, as already described for the container 40.

Figure 9:
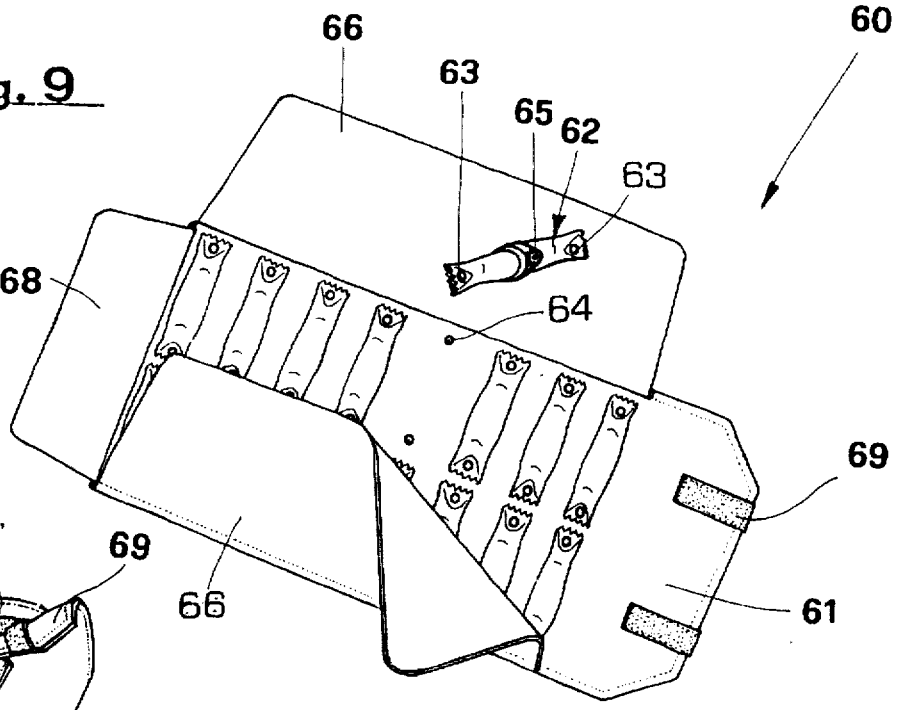
FIG. 9. Open view of a soft container for rings.
Figure 10:
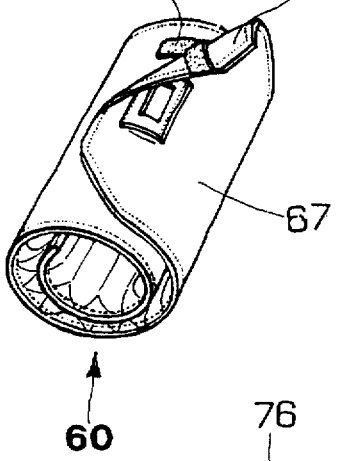
FIG. 10. The same as above when closed.

On completion of its production the container has been treated to make it fully antiseptic even in the small spaces created by stitching and by the various fixing systems. FIGS. 9 and 10 show a soft container 60 for rings, consisting of front pieces 61, 66, 68 and the back piece 70 put together by stitching.

The little ring-holder 'sausages' 62, fixed by buttons 63, 64 clearly show the kind of rings 65 they carry as may be seen in the Figure.

Figure 12:
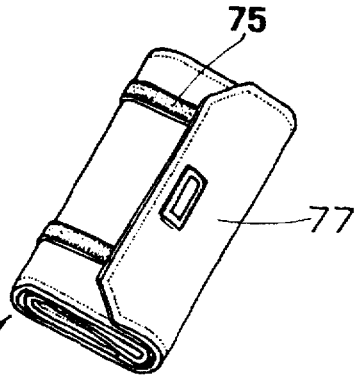
FIG. 12. The same as above when closed.
Figure 11:
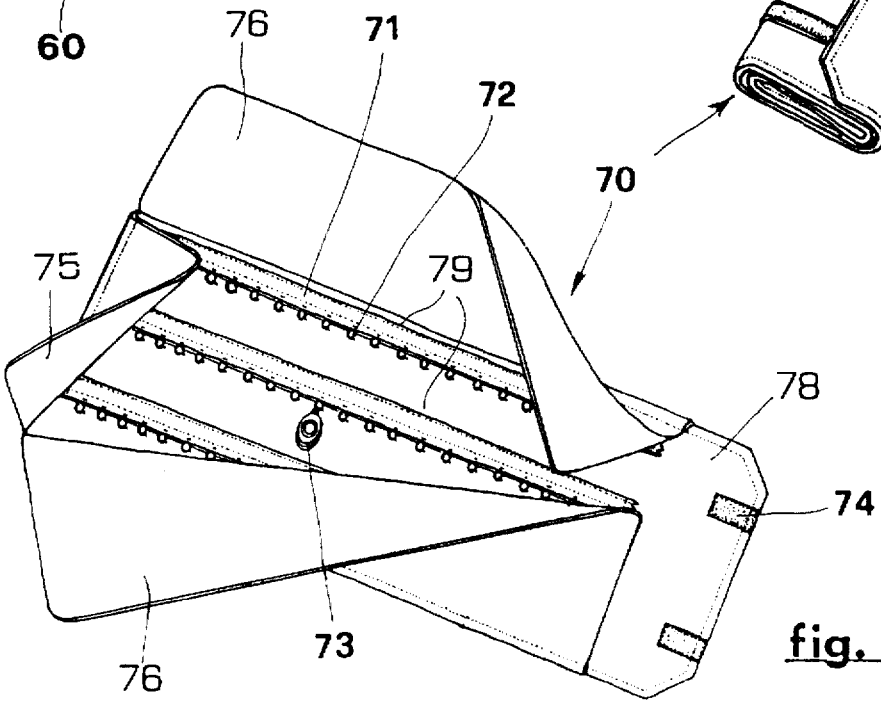
FIG. 11. Open view of a soft container for pendants.

The container is closed by Velcro strips 69, 69'. All components of the container have been previously treated as described for the earlier examples of containers. In FIGS. 11 and 12 a soft container for medals and badges 70, comprises front pieces 75, 76, 78 and a back piece 77 held together by stitching.

The longitudinal strips 71, made by folds of material fixed to the bottom of the container by stitching 79, carry rings 72 to which medals 73 may be applied. Closure is made by bands of Velcro 74, 75.

Figure 14:
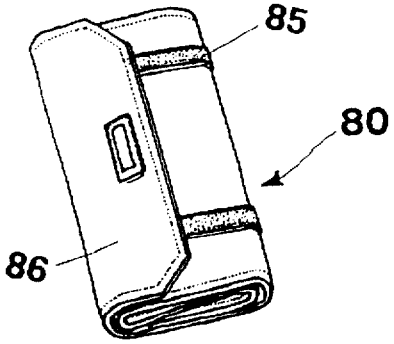
FIG. 14. The same as above when closed.
Figure 13:
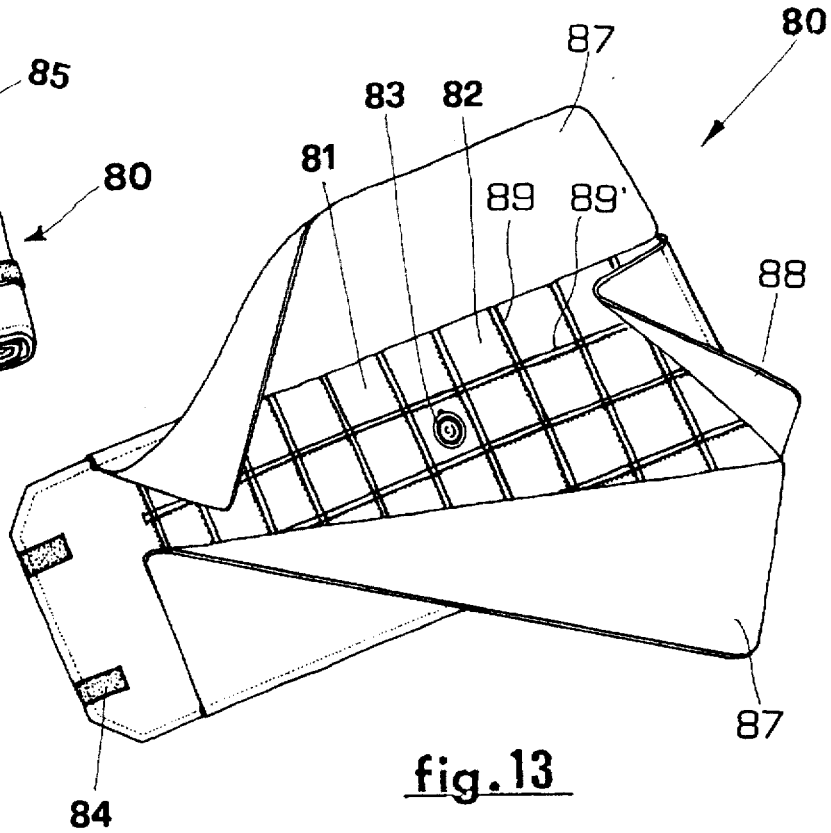
FIG. 13. Open view of a soft container for medals.
Figure 15:
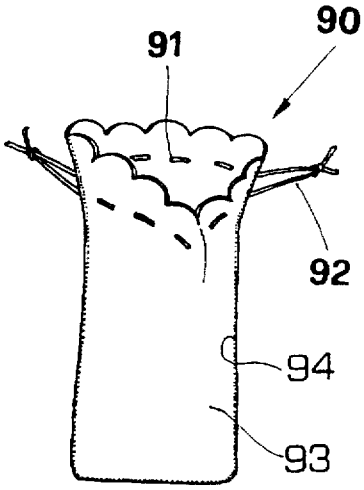
FIG. 15. A bag type of container.

FIGS. 13 and 14 illustrate a soft container for medals made of front pieces 81, 87, 88 and a back piece 86 sewn together. On the front piece orthogonal lines of stitching create crossed lines of ribbing 89, 89' which form compartments 82 for medals 83.

Figure 23:
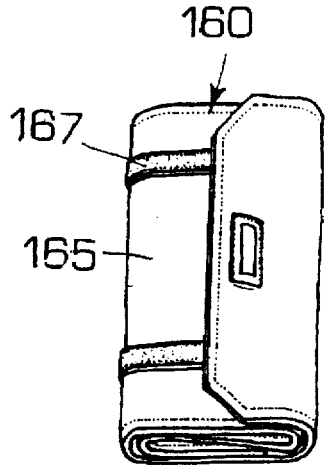
FIG. 23. The same as above when closed.
Figure 22:
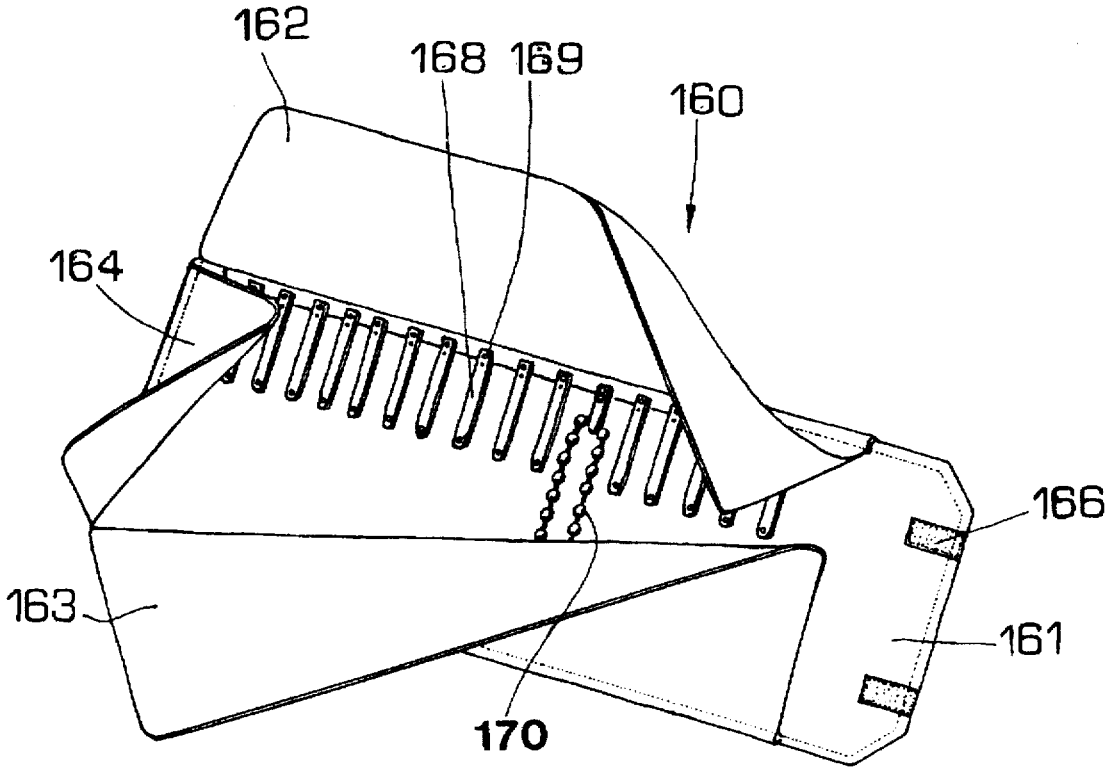
FIG. 22. Open view of a soft container for necklaces.

FIGS. 22 and 23 show a container 160 for necklaces. In this container the front pieces 161, 162, 163, 164 are joined by stitching to the back piece 165.

The container is closed by bands of Velcro 166 and 167. Tapes 168 fixed by buttons 169 to the base of the container, hold the necklaces in place, as in 170.

All component parts of the containers described above, the front and back folding pieces, the strips of Velcro and all accessories for keeping the contents in place, as well as the finished containers, are treated with antibacterial and antimycotic chemical preparations.

FIG. 5 shows a bag-style container 90 consisting of a single piece 93 with holes 91 and stitching 94, the cord 92 passing through the holes. After manufacture, all parts of the bag are treated in the same way as previously described containers.

Figure 16:
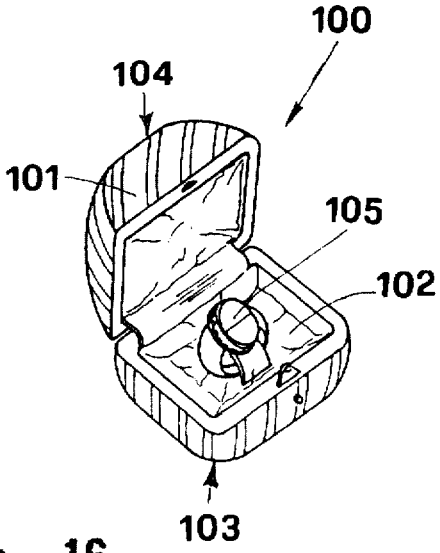
FIG. 16. A container in the form of an individual case.

In FIG. 16 a small box container 100 is seen formed of two shell-like parts 103, 104 clad with stuff 101 on the out—and lined with stuff 102 on the inside.

This box holds a ring 105.

Figure 17:
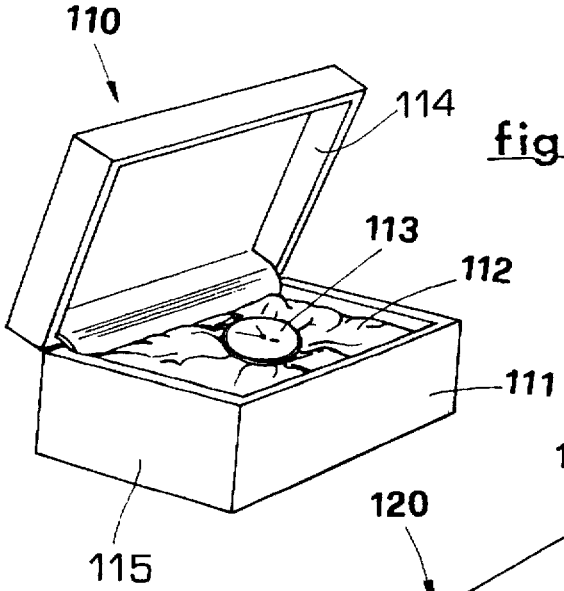
FIG. 17. A box type of container.

FIG. 17 illustrates a box-shaped container 110 with sides 111, outer cladding 114, 115 and a cushion 112 inside on which to lay the watch 113.

Figure 18:
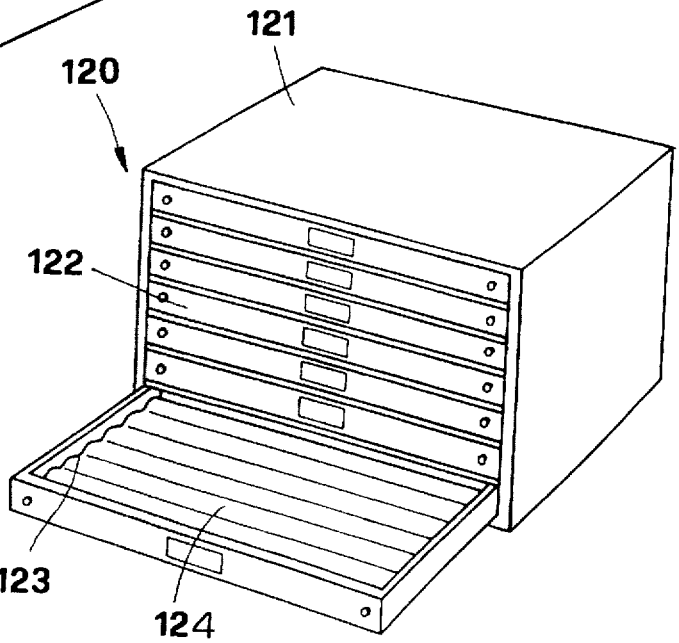
FIG. 18. A container consisting of a set of drawers.
Figure 19:
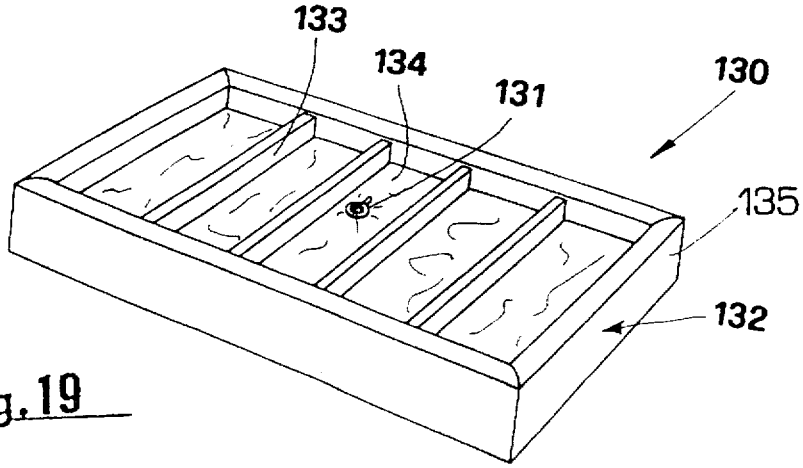
FIG. 19. A tray type of container.

FIG. 18 illustrates a container consisting of a set of drawers 120 with a shell 121, drawers 122 each of which is lined inside 123 and divided into lengthwise sections 124. In FIG. 19 a tray-type container 130 comprises a structure 132 lined with stuff 135 and divided into sections each of which is also lined.

Figure 20:
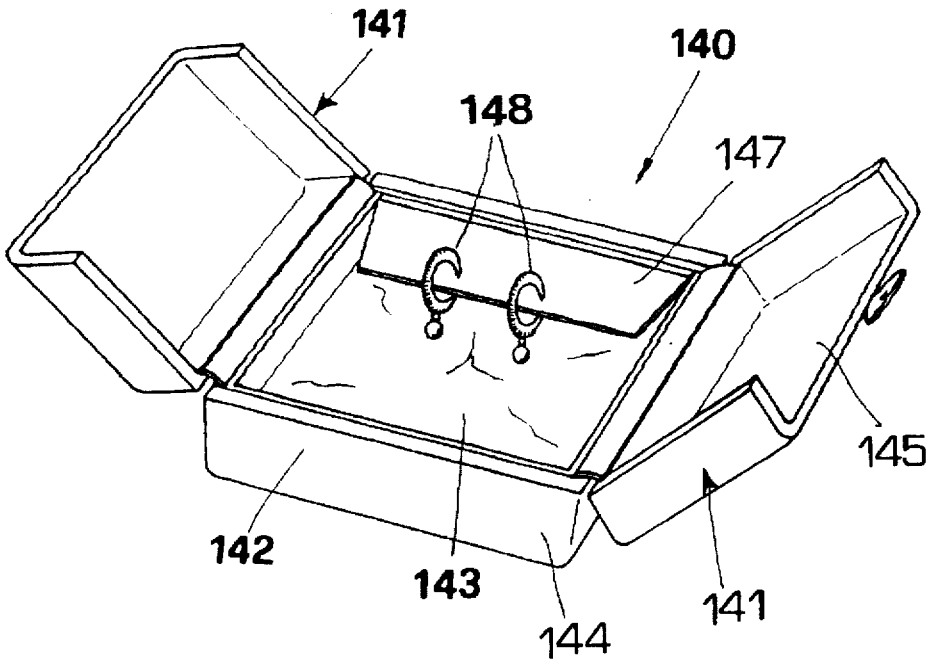
FIG. 20. A casket type of container.

The cushions 134 inside each compartment provide a suitable base on which to place the objects 131 in this container. The container seen in FIG. 20 is of the casket type 140 for earrings and is constructed with a central part 142 and lids 141 opening outward lined with stuff 145 inside. The inner cushion 143 protects the earrings 148 applied to the flap 147.

Figure 21:
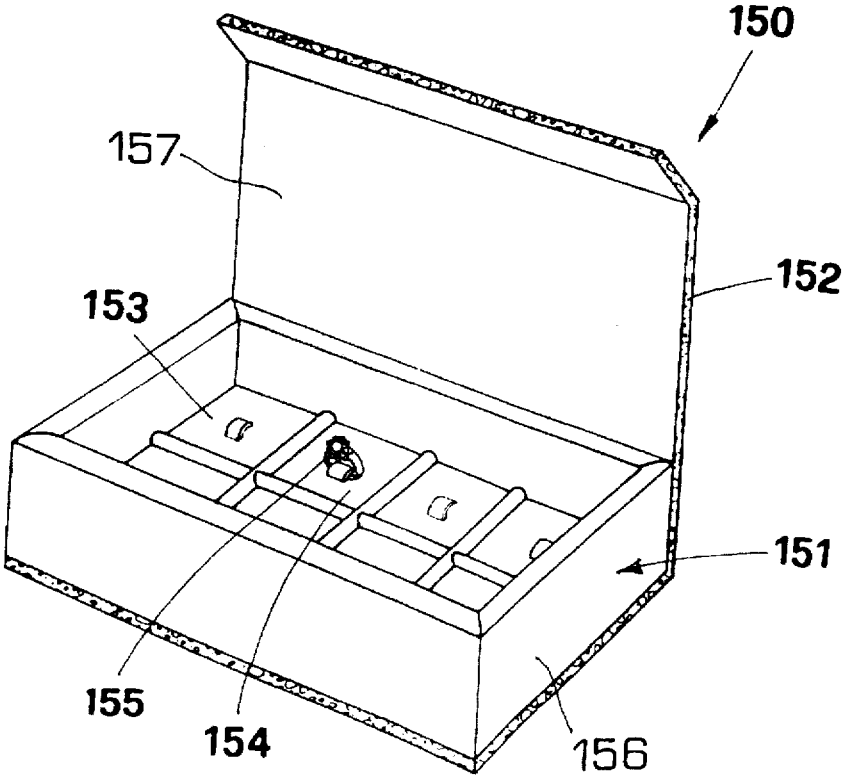
FIG. 21. A sample-case type of container.

FIG. 21 shows a sample-case-type container 150 consisting of a box 151 and lid 152 clad with stuff 156, 157. Objects such as the ring 155 are fitted into compartments 154 on the bottom 153 of the box.

All parts of these containers, both the structures of wood, plastic or metal and the claddings and linings whether these be of stuff, paper, plastic, and all accessories for holding the objects, cushion stuffing and anything else have been previously treated with chemical preparations, as explained. Treatment has also been given after manufacture to make quite sure that all small spaces, cavities and voids created by the various components glued on, sewn and fixed by various means are covered by the above antiseptic precautions.

It will be understood that each of the elements described above, or two or more together, may also find a useful application in other types of constructions differing from the types described above.

While the invention has been illustrated and described as embodied in a container for cutlery, jewelry and imitation jewelry given anti-bacterial and anti-mycotic treatment, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A container for protection and display of objects of jewelry including cutlery of precious metals, the container comprising a basic structural piece having four angles and four sides; one upper, one lower, and two lateral side flaps on the four sides being as short as their respective sides and wide as substantially half a shorter side of the basic structural piece; at least one extra piece superimposed over and connected to said basic structural piece so as to form pockets for the objects, said basic structural piece, said flaps and said extra piece being composed of a flexible material selected from the group consisting of cloth, leather, plastic, non-woven fabric and woven fabric so that the objects of jewelry can be laid out for display on said basic structural piece lying parallel to shorter sides of said basic structural piece, the flaps can be folded over said basic structural piece to protect and cover the objects and the container can be closed by folding said upper and lower flaps onto the basic structural piece and onto each other and folding said container around geometrical axes parallel to the objects displayed and protected; first means that form compartments for the objects; second means applied to said basic structural piece, that form supports for the objects; and third means for keeping the container folded in its closed position, said first and second means being covered with pieces of material selected from the group consisting of clothes, plastic, non-woven fabric and woven fabric, the container, the basic structural piece, the extra pieces, the flaps, said pockets, said compartments and each said means being chemically treated to provide antibacterial, antimold, antiseptic action throughout the container to avoid infection that might be caused by repeated handling by different persons of the objects displayed in the container.

2. A container as defined in claim 1, wherein said flaps are made of one piece with said basic structural piece.

3. A container as defined in claim 1, wherein said flaps are formed as extra pieces joined to said basic structural piece by stitching.

4. A container as defined in claim 1, wherein said extra pieces superimposed on said basic structural piece are fixed to said basic structural piece by stitching on the short sides of said basic structural piece so as to form pockets to form several superimposed layers in which the object can be placed so that the container can be closed by folding it over with folds parallel to the objects inserted.

5. A container as defined in claim 1, wherein said extra pieces superimposed on said basic structural piece are fixed to said basic structural piece by stitching on the short side of said basic structural piece so as to form pockets with several superimposed layers in which the objects may be placed even if only partially.

6. A container as defined in claim 1, wherein said second means are in the form of strips.

7. A container as defined in claim 1, wherein said third means include at least one pair of complementary strips connectable with one another, one strip of said at least one pair being joined to said basic structural piece while another strip in said pair is joined at least to one of said flaps.

8. A container as defined in claim 1, wherein the container is closeable by folding said upper and lower flaps over said basic structural piece and folding it over; and further comprising means for keeping the container in the folded over position.

9. A container as defined in claim 1, wherein said container is foldable over around its own axis of cemetry to form a bag so that at least one flap is folded onto the folded container to close the back; and further comprising folding means including two complementary strips connectable to one another to close the bag.

10. A container as defined in claim 1, wherein said container is repeatedly foldable over around its own axis of cemetry to form a roll, then one of said lateral flaps is foldable onto the container to close the roll; and further comprising closing means including two complementary strips connectable to one another to close the roll.

* * * * *